US005493174A

United States Patent [19]

Mori

[11] Patent Number: 5,493,174

[45] Date of Patent: Feb. 20, 1996

[54] IMAGING TUBE HAVING IMPROVED FLUORESCENT SURFACE STRUCTURE ON FIBER OPTIC PLATE

[75] Inventor: Kuniyoshi Mori, Hamamatsu, Japan

[73] Assignee: Hamamatsu Photonics K.K., Shizuoka, Japan

[21] Appl. No.: 33,345

[22] Filed: Mar. 18, 1993

[30] Foreign Application Priority Data

Mar. 19, 1992 [JP] Japan ..... 4-063833

[51] Int. Cl.[6] ..... H01J 29/28; H01J 31/50

[52] U.S. Cl. ..... 313/371; 313/372; 313/475; 313/524; 313/525; 313/528; 313/544

[58] Field of Search ..... 313/371, 372, 313/466, 473, 475, 524, 525, 528, 530, 542, 544; 250/214 VT

[56] References Cited

U.S. PATENT DOCUMENTS

| | | | |
|---|---|---|---|
| 3,567,947 | 3/1971 | Robbins . | |
| 3,760,216 | 9/1973 | Lasser et al. . | |
| 3,772,562 | 11/1973 | Goodrich . | |
| 3,835,314 | 9/1974 | Grossel et al. . | |
| 4,961,026 | 10/1990 | Funk et al. | 313/525 |
| 5,023,511 | 6/1991 | Phillips | 313/524 |

FOREIGN PATENT DOCUMENTS

| | | |
|---|---|---|
| 50-99674 | 8/1975 | Japan . |
| 54-111754 | 9/1979 | Japan . |
| 7508792 | 1/1977 | Netherlands . |

OTHER PUBLICATIONS

"Transparent, Electrically Conductive Film," *Top Of Mind,* No. 57, Ichinose et al., pp. 25–28 (Apr. 1991).

"High Quality Phosphor Screen by Electro Phoretic Deposition Method"; Electronic Communications Society Technical Research Report; vol. 76, No. 223, K. Terashima et al.; Feb. 17, 1977.

*Primary Examiner*—Donald J. Yusko
*Assistant Examiner*—N. D. Patel
*Attorney, Agent, or Firm*—Sughrue, Mion, Zinn, Macpeak & Seas

[57] ABSTRACT

An imaging tube having a fiber optic plate (FOP) as an output faceplate. On one surface of the FOP within an evacuated envelope is deposited a first transparent conductive layer. On the first transparent conductive layer is deposited a fluorescent layer. On the fluorescent layer is deposited a metal-back electrode. On the other surface of the FOP outside the evacuated envelope is deposited a second transparent conductive layer. The first transparent conductive layer and the metal-back electrode are electrically connected so that an electrical field is not developed across the fluorescent layer when the metal-back electrode is applied with a high positive voltage and the second transparent conductive layer is grounded. Therefore, even if leakage currents flow through the FOP, electric charges impinging upon the first transparent conductive layer will not cause the fluorescent layer to generate noise spots.

7 Claims, 2 Drawing Sheets

IMAGING TUBE HAVING IMPROVED FLUORESCENT SURFACE STRUCTURE ON FIBER OPTIC PLATE

BACKGROUND OF THE INVENTION

1. Field of the Invention

The present invention relates to an imaging tube including an image intensifier, a framing tube, and a streak tube.

2. Description of the Related Art

One conventional imaging tube is an X-ray fluorescence multiplier tube provided with a photocathode and a fluorescent surface, and is disclosed in Japanese Laid-Open Patent Publication SHO-53-67347. The fluorescent surface of this multiplier tube is formed using electrophoretic techniques and is a multi-layer structure consisting of a transparent conductive layer, a fluorescent layer, and a metal thin layer which are sequentially deposited in the stated order on the inner surface of a glass plate (an output faceplate) facing the photocathode.

To improve optical coupling at the output of the imaging tube, a fiber optic plate (FOP) is generally used as an output faceplate. The fluorescent surface of the imaging tube in which the FOP is used is a two-layer structure. Specifically, the fluorescent layer is directly deposited over the inner surface of the FOP and the thin metal layer is deposited over the fluorescent layer. The thin metal layer prevents light generated at the fluorescent layer from feeding back toward the photocathode, and so is called a metal-back film.

Generally, the imaging tubes with FOPs are used in conjunction with a solid-state image pick-up device. In use, the image pick-up device is mounted directly on the FOP. In order to maintain the image pick-up device at ground potential, a transparent conductive layer is formed on the outer surface of the FOP to connect it to ground. On the other hand, because the metal-back thin film is applied with a positive high voltage, a strong electric field is developed between the inner and outer surfaces of the FOP. This strong electric field causes electric charges to appear in the fluorescent layer as a result of leakage currents flowing through the FOP. Due to the electric charges in the fluorescent layer, dark spots are locally observed at the output side of the FOP for a brief period of time when light is uniformly applied to the photocathode. The dark spots finally disappear, because the fluorescent layer which normally has electrical insulation properties exhibits conductive properties when the fluorescent layer generates light, so the electric charges are released from the fluorescent layer soon after the imaging tube is operated.

Further, due to discharges occurring between the metal-back thin film and the FOP caused by the strong electric field developed across the fluorescent layer or by electrons incident into the fluorescent layer from the FOP, bright spots are locally observed at the output side of the FOP when no light is applied to the photocathode. These dark spots and bright spots have the same pattern because these spots are generated resulting from the fact that some fibers of the FOP exhibit conductivity.

While the use of heavily insulated FOPs can prevent the generation of dark and bright spots, that is, degradation of image quality, the expense of heavily insulated FOPs creates an additional problem by increasing the total cost of imaging tubes in which they are used. Also, dark spots and bright spots tend to occur easily even when highly insulated FOPs are used, if the FOPs are slenderized or high voltage is applied thereto.

SUMMARY OF THE INVENTION

It is therefore an object of the present invention to overcome the above-described drawbacks, and to provide an imaging tube which prevents the formation of dark spots and light spots.

To achieve the above and other objects of the invention, there is provided an imaging tube which includes a photocathode for producing photoelectrons in response to radiation incident thereon and a fiber optic plate. The fiber optic plate is arranged so that a first side thereof is oriented in a direction to confront the photocathode. A first transparent conductive layer is deposited over the first side of the fiber optic plate, a fluorescent layer is deposited over the first transparent conductive layer, and a metal-back electrode is formed on the fluorescent layer. A second transparent conductive layer is deposited over a second side of the fiber optical plate.

Preferably, the first transparent conductive layer and the metal-back electrode are electrically connected so that an electric field does not develop across the fluorescent layer, whereby the cause which produces dark and bright spots is eliminated. The first transparent conductive layer may be electrically disconnected from the metal-back electrode so that the electric field across the fluorescent layer becomes substantially uniform even if electric charges appear on the first transparent conductive layer.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*b*) is a cross-sectional diagram showing a structure of a fluorescent surface formed on a FOP of the imaging tube shown in FIG. 1(*a*);

FIG. 1(*c*) is a cross-sectional diagram showing a modified structure of a fluorescent surface formed on a FOP.

DETAILED DESCRIPTION OF THE PREFERRED EMBODIMENTS

Figure 1A:
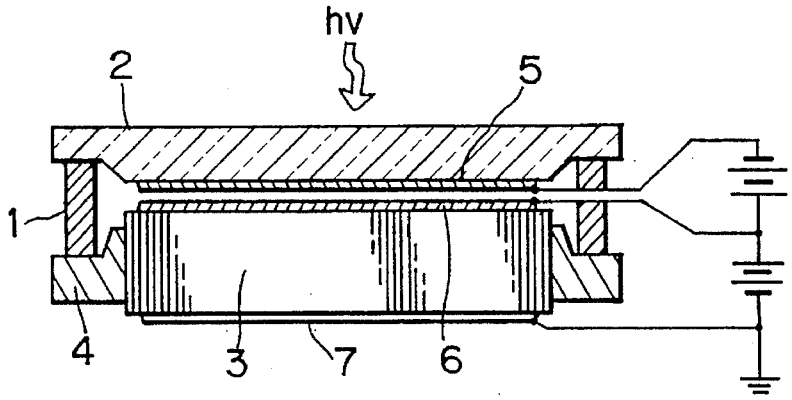
FIG. 1(*a*) is a cross-sectional diagram showing an overall arrangement of a proximity-type imaging tube according to a first embodiment of the present invention.

Referring to the accompanying drawings, preferred embodiments of the invention will now be described wherein like parts and components are designated by the same reference numerals to avoid duplicating description.

Figure 1B:
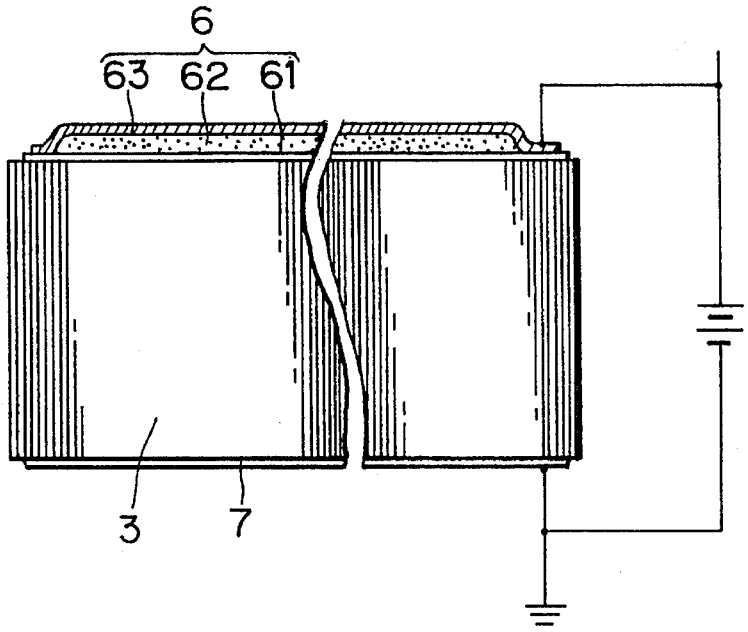
Figure 1C:
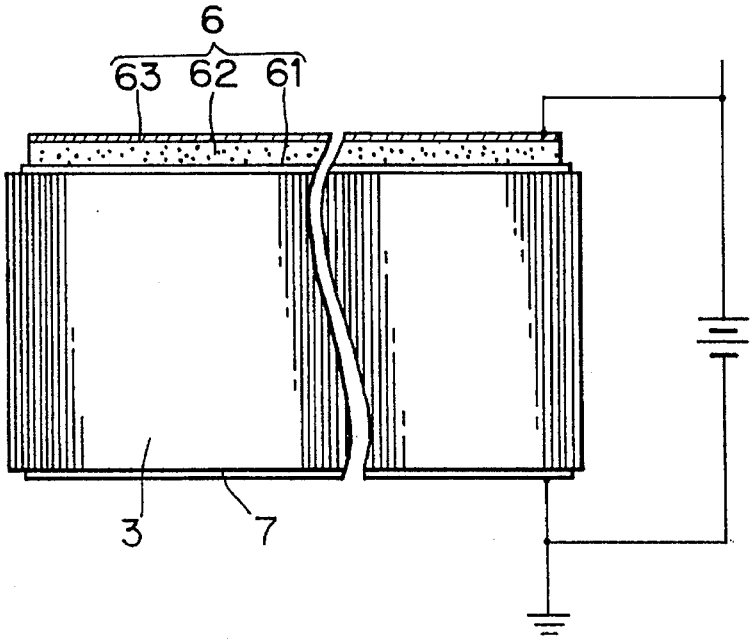

As can be seen in FIG. 1(*a*), an evacuated envelope is formed from a cylindrical vessel 1 with a generally circular glass faceplate 2 hermetically attached to one opening thereof. A fiber optic plate (FOP) is attached at the other opening of the cylindrical vessel 1 is and is also affixed hermetically via a support 4. A photocathode 5 is formed on the inner surface of the faceplate 2 from a material such as an alkali metal. A fluorescent surface 6 is formed on the side of the FOP 3 confronting the photocathode 5.

As shown in FIG. 1(*b*), the fluorescent surface 6 consists of three layers; a first transparent conductive layer 61 made from indium tin oxide (ITO) which is deposited over the FOP 3, a fluorescent layer 62 with high insulation properties deposited over the first transparent conductive layer 61, and a metal-back electrode 63 (made from aluminum) formed on the fluorescent layer 62. The edge of the metal-back electrode 63 connects to the edge of the first transparent conductive layer 61 to maintain the first transparent conductive layer 61 and the metal-back electrode 63 at the same potential. At the surface of the FOP 3 opposing the fluorescent surface 6 is formed a second transparent conductive layer 7 also made from ITO. The second transparent conductive layer 7 is connected to ground.

The fluorescent surface 6 is connected to a positive potential higher than that of the photocathode 5. Therefore, when the photocathode 5 generates photoelectrons upon being struck by incident light (hv), the generated photoelectrons become incident to the fluorescent surface 6, which fluoresces as a result. Because the second transparent conductive layer 7 provided at the outer surface of the FOP 3 is grounded, a strong electric field is developed across the FOP 3. Therefore, some leakage currents may flow through the FOP 3. However, even if the leakage currents flow therethrough, electric charges incident upon the first transparent conductive layer 61 are released therefrom. Consequently, discharges in areas of the fluorescent layer 62 and charge-ups into the fluorescent layer 62 will not occur.

Therefore, after applying voltage to the imaging tube and immediately after starting the imaging, no bright and dark spots are generated. Therefore, image quality is improved, especially during the period three to thirty seconds after the start of imaging when dark spots are most likely to occur.

The imaging tube shown in FIG. 1(*c*) is a modification of the tube shown in FIGS. 1(*a*) and 1(*b*), wherein the first transparent conductive layer 61 and the metal-back electrode 63 are electrically disconnected from each other and the first transparent conductive layer 61 is held in a floating condition. The first transparent conductive layer 61 may be held at a potential differing from that of the metal-back electrode. With such structures, a uniform electric field across the fluorescent layer 62 can be attained even though the discharges in areas of the fluorescent layer 62 and charge-ups into the fluorescent layer 62 may occur, unlike the embodiment shown in FIGS. 1(*a*) and 1(*b*). Consequently, the dark spots and bright spots do not become notable at the output side of the FOP.

The material for the first transparent conductive layer 61 is not limited to ITO. However, it is desirable that the first transparent conductive layer 61 be a layer thin enough (for example, one thousand to several thousand angstroms for ITO) to prevent reductions in image quality.

Figure 2:
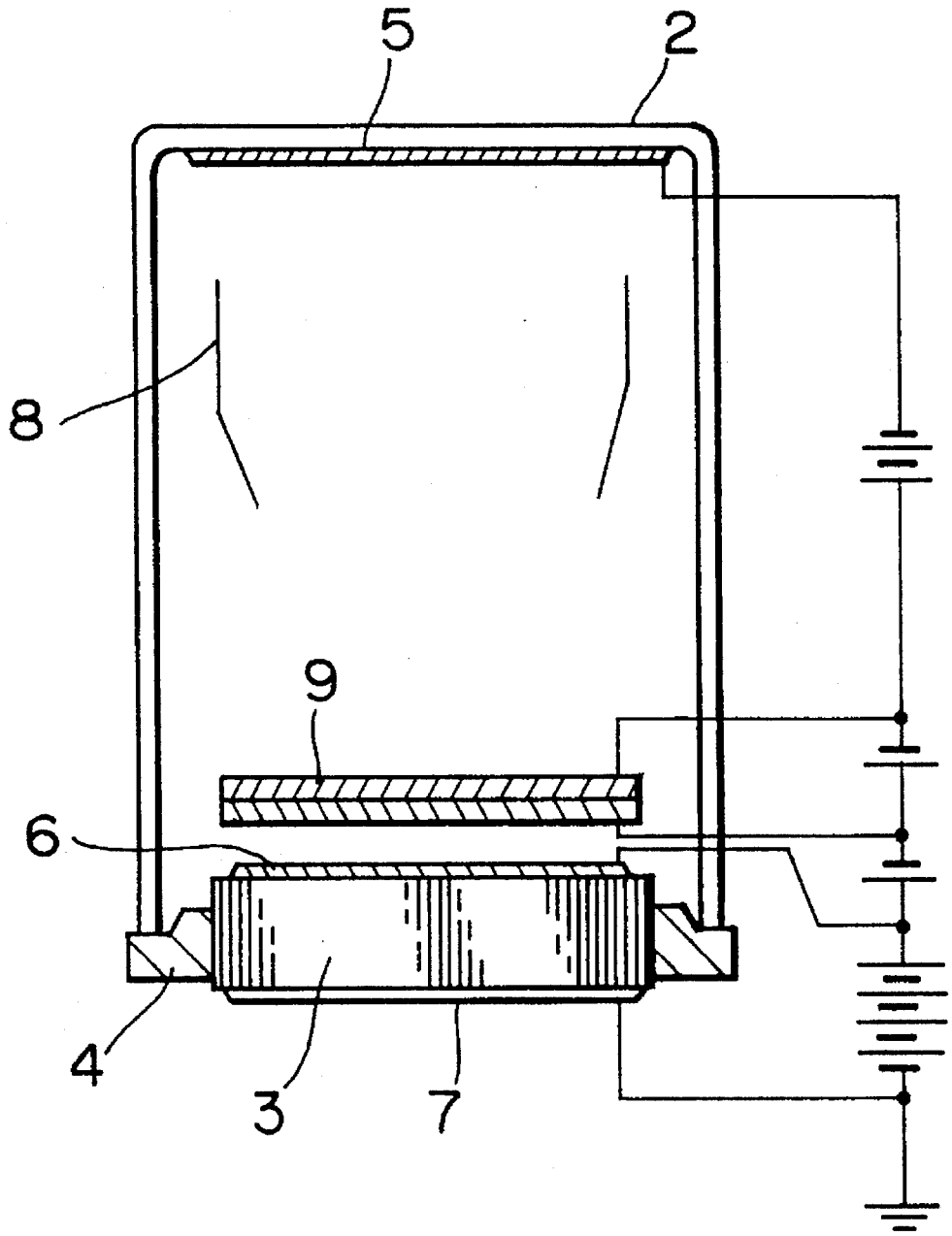
FIG. 2 is a cross-sectional diagram showing an overall arrangement of an imaging intensifier according to a second preferred embodiment of the present invention.

FIG. 2 is a cross-sectional diagram showing an imaging intensifier according to a second preferred embodiment of the present invention. The output portion of the imaging intensifier is the same as that shown in FIG. 1(*b*). In the second preferred embodiment, the faceplate 2 is formed integral with a glass envelope. An electron lens 8 for focusing the electron beam and a microchannel plate (MCP) 9 for multiplying the electrons are provided between the photocathode 5 and the fluorescent surface 6.

In the second preferred embodiment, the electric potential between the fluorescent surface 6 and the second transparent conductive layer 7 is generally greater, so that the favorable effects gained by using the present invention become more pronounced.

As described above, an imaging tube according to the present invention has a first transparent conductive layer deposited over the inner surface of an FOP. Because the fluorescent layer and the conductive reflective layer are formed on the surface of the first transparent conductive layer, all have the same high positive electric potential. Therefore, even if leakage current is generated partially at the inner portion of the FOP due to its structure of having a second transparent conductive layer deposited over the outer surface of the FOP and grounded, electric charges do not appear in the fluorescent layer. Because this eliminates any need to use heavily insulated FOPs, providing a high performance imaging tube at low cost becomes possible. Use of thinner FOPs also becomes possible.

Although the present invention has been described with respect to specific embodiments, it will be appreciated by one skilled in the art that a variety of changes may be made without departing from the scope of the invention. For example, certain features may be used independently of others and equivalents may be substituted all within the spirit and scope of the invention.

What is claimed is:

1. An imaging tube comprising:

a photocathode for producing photoelectrons in response to radiation incident thereon;

a fiber optic plate having a first side and a second side opposing the first side, said fiber optic plate being arranged so that the first side is oriented in a direction to confront said photocathode;

a first transparent conductive layer deposited over the first side of said fiber optic plate;

a fluorescent layer deposited over said first transparent conductive layer;

a metal-back electrode formed over said fluorescent layer; and a second transparent conductive layer deposited over the second side of said fiber optic plate;

wherein said first transparent conductive layer and said metal-back electrode are electrically connected.

2. The imaging tube according to claim 1, wherein said first transparent conductive layer is made from indium tin oxide.

3. The imaging tube according to claim 1, further comprising first means for connecting said metal-back electrode to a positive voltage terminal of a power source, and second means for connecting said second transparent conductive layer to ground.

4. The imaging tube according to claim 3, further comprising electron multiplying means for multiplying the photoelectrons produced from said photocathode.

5. The imaging tube according to claim 3, further comprising means for applying a first positive voltage to said photocathode, and means for applying a second positive voltage higher than the first positive voltage to said metal-back electrode.

6. An imaging tube comprising:

an envelope having a first opening and a second opening;

a transparent faceplate hermetically attached to the first opening of said envelope, said transparent faceplate having a first surface and a second surface;

a photocathode provided on the second surface of said transparent faceplate for producing photoelectrons in response to radiation incident on said faceplate;

a fiber optic plate hermetically attached upon evacuation to the second opening of said envelope, said fiber optic plate having a first side and a second side opposing the first side, said fiber optic plate being arranged so that the first side is oriented in a direction to confront said photocathode;

a transparent electrically conductive layer deposited over the first side of said fiber optic plate;

a fluorescent layer deposited over said transparent electrically conductive layer; and an electrically conductive layer deposited over said fluorescent layer, wherein said transparent electrically conductive layer and said electrically conductive layer deposited over said fluorescent layer are electrically connected.

7. The imaging tube according to claim 6, wherein said envelope and said faceplate are integrally formed.

* * * * *